United States Patent [19]

North

[11] Patent Number: 4,718,662

[45] Date of Patent: Jan. 12, 1988

[54] TONGUE POSITIONING AND EXERCISING DEVICE

[76] Inventor: Richard B. North, 1321 SE. Magnolia Dr., Roseburg, Oreg. 97470

[21] Appl. No.: 813,413

[22] Filed: Dec. 26, 1985

[51] Int. Cl.[4] ..... A63B 23/00; A61F 5/56

[52] U.S. Cl. ..... 272/95; 128/136

[58] Field of Search ..... 272/95; 128/136, 62 A, 128/62 R, 137, 15; 433/136; 434/185; D24/49, 64

[56] References Cited

U.S. PATENT DOCUMENTS

| | | | |
|---|---|---|---|
| 1,365,684 | 1/1921 | Guise | 128/136 |
| 2,077,245 | 4/1937 | Locke | 128/136 |
| 3,103,052 | 9/1963 | Rector | 128/136 |
| 3,768,477 | 10/1973 | Anders et al. | 128/15 |
| 3,871,370 | 3/1975 | McDonald | 128/136 |
| 4,185,817 | 1/1980 | Peterson | 272/95 |

*Primary Examiner*—Richard J. Apley
*Assistant Examiner*—S. R. Crow

[57] ABSTRACT

A device having an outer marginal area for clenched retention between the upper and lower teeth. Tongue supporting members extend inwardly and upwardly from the marginal area to properly position the tongue with the tongue tip in contact with the upper alveolar ridge of the gum. Openings permit passage of saliva through the device. Projections, on a modified form of the device, cause tongue discomfort if the tongue is improperly located below the device.

7 Claims, 7 Drawing Figures

TONGUE POSITIONING AND EXERCISING DEVICE

BACKGROUND OF THE INVENTION

The present invention concerns a dental device for temporary retention between the upper and lower teeth of the wearer for the purpose of elevation and exercising of the peripheral portion of the tongue against the upper alveolar ridge, encouraging the proper funtion of the tongue musculature during rest and swallowing.

Briefly the device achieves strengthening the tongue musculature for better production of speech sounds, correcting defective speech sounds, improving tongue/lip strength during extended playing of some musical instruments, reducing dental decay by maintaining the tongue position above the upper teeth during the swallowing of food, and correcting tongue thrust swallowing.

Habitual thrusting of the tongue forwardly has an adverse effect both on the mouth and on speech patterns.

Pressure exerted against the lingual surfaces of the upper anterior teeth often results in dental deformation and/or malocclusion to the extent that orthodontal treatment must be resorted to. Continuance of the tongue thrusting habit after orthodontic efforts can cause the dental structures to, at least partially, return to the original malocclusion.

Speech therapists have attributed certain speech problems to the child having the tongue thrusting habit. Some speech problems are attributable to the child continuously positioning the tongue against or between the dention instead of properly positioning same above the upper dental arch. Swallowing of saliva about every minute and of food is also adversely affected by improper tongue position and function. The production of certain speech sounds and combinations thereof are particularly adversely affected by improper tongue habits.

U.S. Pat. No. 3,259,129 provides a discussion of tongue thrusting problems and discloses a remedial device which administers an electric charge to the tongue when improperly located.

The subject of the present invention serves to physically position and stimulate exercising the proper tongue musculature during rest position and swallowing.

SUMMARY OF THE INVENTION

The present invention is embodied within a device for retention between the upper and lower teeth for the purpose of training tongue musculature for the purpose of overcoming the condition known as tongue thrusting, and to strengthen the tongue musculature in anyone desiring improved speaking abilities or improved endurance during playing of certain brass or woodwind instruments.

The device is formed of material which lends itself to convenient sizing and shaping to provide a frontal marginal area against which the teeth may close. An elevated inner portion of the device serves to elevate the tongue to its proper location within the upper dental arch. Elevated portions of the device are located on opposite sides of the center line of the device with an open area there between serving to receive the tongue frenulum. Accordingly, the tongue assumes a normal rest position touching upper alveolar ridge of the mouth with the tongue positioned away from lingual surfaces of the teeth. Wearing of the device for brief periods during the day or while sleeping conditions the tongue musculature with the result that eventually the tongue will automatically assume the correct position and function unaided by the device.

Such training of the tongue musculature is of further benefit in that certain speech problems, caused by improper tongue function and position are overcome to a considerable extent. The proper positioning of the tongue touching the upper alveolar ridge avoids substantial tongue exerted pressure on tooth surfaces which eventually results in malocclusion. The device is intended to be worn in a comfortable manner by the user with provision made for saliva sucking action and avoidance of interference with the tongue frenulum.

The tongue positioning and exercising device benefits those individuals who have been diagnosed as having dental, orthodontic, periodontic, or speech problems caused by improper tongue habits. This device will also encourage strengthening of the tongue musculature to produce better speaking abilities and will promote increased endurance during extended playing of certain woodwind and brass instruments.

Important objectives include the provision of a tongue positioning and exercising device for comfortable wear by the user for periodic usage which positions and exercises the tongue in an elevated manner to train the several muscles controlling tongue movement; the provision of a tongue positioning and exercising device which is of inexpensive construction so as to make its use practical for a wide range of users.

DETAILED DESCRIPTION OF THE PREFERRED EMBODIMENTS

Figure 1:
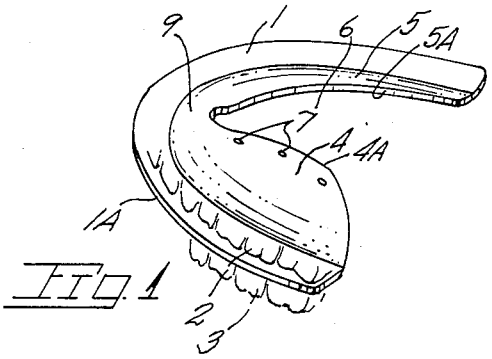
FIG. 1 is a downward perspective view of the present device.
Figure 2:
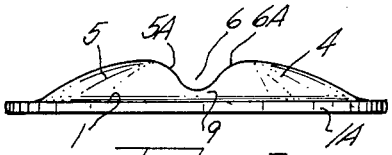
FIG. 2 is a front elevational view thereof.

With continuing attention to the drawings wherein applied reference numerals indicate parts similarly hereinafter identified, the reference numeral 1 indicates an outer frontal marginal area of the present device which area is of curved configuration and substantially horizontal for clenching between the upper and lower teeth of the wearer partially shown in phantom lines at 2 and 3. An outer rim of the device is at 1A.

Figure 3:
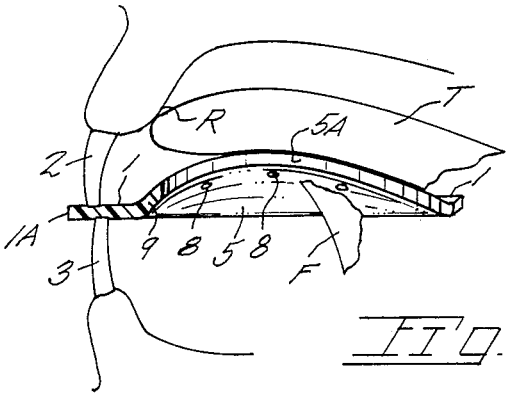
FIG. 3 is an enlarged vertical sectional view thereof taken along a medial center line of the device with parts of the mouth also shown in section.
Figure 4:
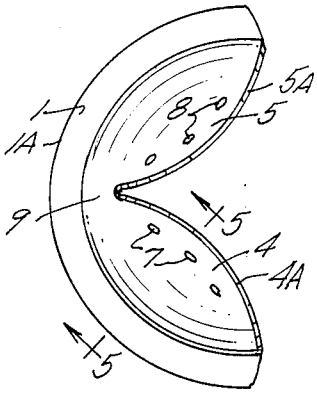
FIG. 4 is a plan view of the device.
Figure 5:
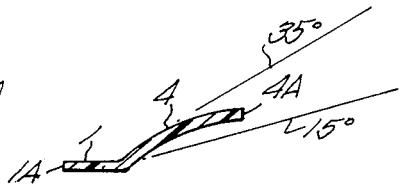
FIG. 5 is a sectional view taken along line 5—5 of FIG. 4.

Indicated at 4 and 5 are inclined tongue supporting members of the device which extend inwardly and upwardly in an inclined manner from marginal area 1. Each of said tongue supporting members has an inner edge as at 4A and 5A which jointly define a generally V-shaped open area at 6 which receives the tongue frenulum depicted as F in FIG. 3. Said tongue supporting portions are concavo-convex and are upwardly inclined for the purpose of elevating the tongue at T to a normal position within the upper dental arch as shown in FIG. 3 and for forming inwardly disposed surfaces for centering the tongue, such positioning of the tongue touching the upper alveolar ridge R. Openings at 7 and 8 in supporting members 4 and 5 permit the upward passage of saliva.

Tongue controlling muscles are trained by wearing of the device periodically during the day and/or night.

Inclination of the members 4 and 5 will range approximately between 15 and 35 degrees from the horizontal.

A central portion 9 of the device is of lesser transverse section than a like section of tongue supporting mmebers 4 and 5.

Figure 6:
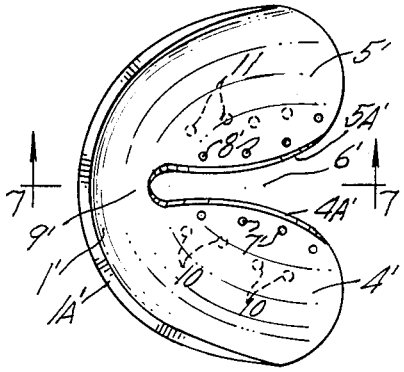
FIG. 6 is a plan view of a modified form of the device.
Figure 7:
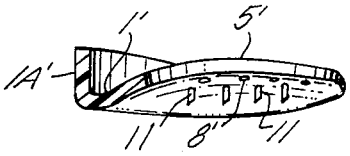
FIG. 7 is a sectional view taken along line 7—7 of FIG. 6.

The modified device in FIGS. 6 and 7 includes a frontal marginal area at 1' having an upwardly directed rim at 1A' which aids in positioning the device.

Indicated at 4' and 5' are inclined tongue supporting members which extend inwardly and upwardly from marginal area 1'. Portions of the device which correspond to those earlier described portions of the first described device are indicated with prime reference numerals.

Molded in place on the tongue supporting members 4' and 5' are projections 10 and 11 which project downwardly to provide negative stimuli should the user's tongue be improperly located below the device. These may be provided by molding the article with the projections in place or thereafter inserted.

While I have shown but a few embodiments of the invention, it will be apparent to those skilled in the art that the invention may be embodied still otherwise without departing from the spirit and scope of the invention.

Having thus described the invention, what is claimed and desired to be secured in a Letters Patent is:

1. A tongue positioning and muscle training device for periodic positioning in clenched engagement with upper and lower teeth of the wearer, said device comprising, a curved frontal marginal area for retentive disposition intermediate the clenched teeth of the upper and lower dental arches, and a pair of inclined tongue supporting portions extending laterally inwardly from said marginal area and each portion having an upper convex surface forming upper rounded tongue supporting surfaces and inwardly disposed surfaces for centering the tongue, said portions with their upper convex surfaces in place in the mouth being dimensioned to be subjacently spaced from the alveolar gum ridge of the wearer's mouth for receiving and elevating the tongue and confining the latter substantially centrally in the mouth for touching the alveolar ridge of the mouth and guiding the tongue above and out of contact with the wearer's teeth.

2. The tongue positioning and muscle training device claimed in claim 1 wherein said tongue supporting portions have a central open rear area arranged to receive the tongue frenulum.

3. The tongue positioning and muscle training device claimed in claim 1 additionally including a central portion of lesser transverse section than said tongue supporting portions.

4. The tongue positioning and muscle training device claimed in claim 1 wherein said tongue supporting portions are inclined so as to lie in a sector defined by about 15 and 35 degree angles to the horizontal.

5. The tongue positioning and muscle training device claimed in claim 1 wherein said frontal marginal area includes an upstanding rim.

6. The tongue positioning and muscle training device claimed in claim 1 additionally including downwardly directed projections on said tongue supporting portions which function as negative stimuli to cause discomfort to the tongue when located below the tongue supporting portions.

7. The tongue positioning and muscle training device claimed in claim 1 wherein said tongue supporting portions define openings for the upward passage of saliva.

* * * * *